US008627533B2

(12) United States Patent
Pichon et al.

(10) Patent No.: US 8,627,533 B2
(45) Date of Patent: Jan. 14, 2014

(54) APPARATUS FOR CLEANING SUBMERGED SURFACE WITH EDDY FILTRATION

(75) Inventors: Philippe Pichon, Villeneuve de Riviere (FR); Emmanuel Mastio, Fourquevaux (FR)

(73) Assignee: Zodiac Pool Care Europe (FR)

( * ) Notice: Subject to any disclaimer, the term of this patent is extended or adjusted under 35 U.S.C. 154(b) by 165 days.

(21) Appl. No.: 12/808,423

(22) PCT Filed: Dec. 18, 2008

(86) PCT No.: PCT/FR2008/052366

§ 371 (c)(1),
(2), (4) Date: Sep. 20, 2010

(87) PCT Pub. No.: WO2009/081056

PCT Pub. Date: Jul. 2, 2009

(65) Prior Publication Data

US 2011/0000031 A1 Jan. 6, 2011

(30) Foreign Application Priority Data

Dec. 21, 2007 (FR) ..... 07 08994

(51) Int. Cl.
*E04H 4/16* (2006.01)

(52) U.S. Cl.
USPC ..... 15/1.7; 210/167.16; 210/232

(58) Field of Classification Search
USPC ..... 15/1.7; 210/167.1, 167.16, 167.17, 210/416.2, 459
See application file for complete search history.

(56) References Cited

U.S. PATENT DOCUMENTS

| | | | | |
|---|---|---|---|---|
| 3,906,572 | A * | 9/1975 | Winn | 15/1.7 |
| 5,172,445 | A | 12/1992 | Chandler | |
| 5,882,512 | A * | 3/1999 | Denkewicz et al. | 210/167.11 |
| 6,013,178 | A * | 1/2000 | Strano et al. | 210/136 |
| 6,155,657 | A * | 12/2000 | Erlich et al. | 305/178 |
| 6,409,916 | B1 * | 6/2002 | Zelas et al. | 210/167.16 |
| 6,473,927 | B1 * | 11/2002 | Sommer | 15/1.7 |

(Continued)

FOREIGN PATENT DOCUMENTS

| | | |
|---|---|---|
| EP | 0468876 | 1/1992 |
| EP | 0989255 | 3/2000 |

(Continued)

OTHER PUBLICATIONS

International Search Report in Application No. PCT/FR2008/052366.

*Primary Examiner* — Mark Spisich
*Assistant Examiner* — Andrew A Horton
(74) *Attorney, Agent, or Firm* — Dean W. Russell; Kilpatrick Townsend & Stockton LLP

(57) ABSTRACT

Detailed is a device for cleaning an immersed surface, including a body and members for driving the body over the immersed surface, a filtration chamber which has a liquid inlet in the body located at the base of the body, at least one liquid outlet out of the body, a hydraulic circuit for flow of liquid between the inlet and the outlet through a filtering device, wherein it includes: at least one rear outlet, and a rigid wall which is arranged in the filtering device and which extends in a direction which is non-parallel with at least one direction which connects an inlet and an outlet in order to form an obstacle to the flow of liquid from this inlet to this outlet which brings about a swirling flow of liquid in the filtering device downstream of this rigid wall.

6 Claims, 6 Drawing Sheets

(56) References Cited

U.S. PATENT DOCUMENTS

Figure 1:
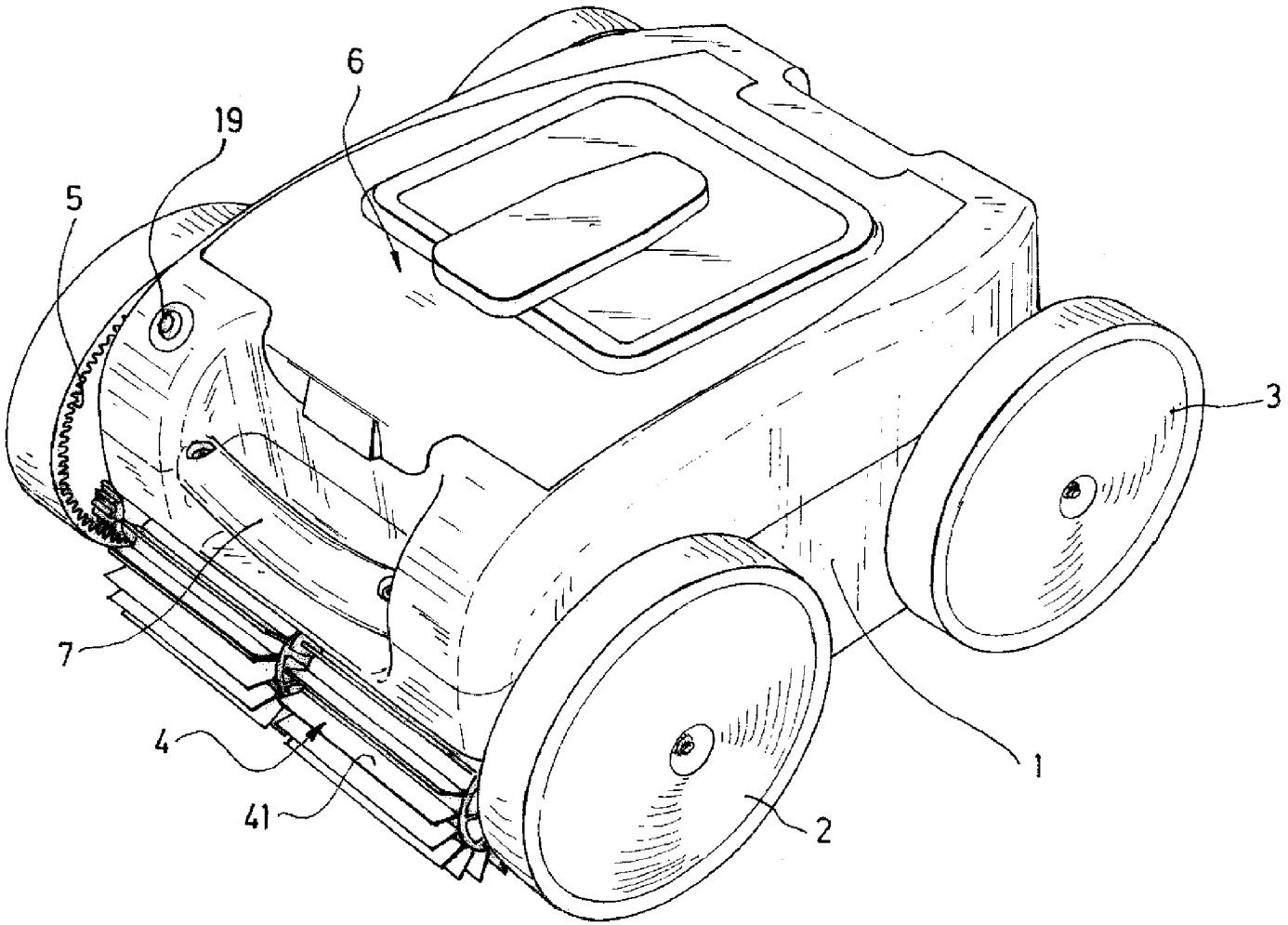

| | | | | |
|---|---|---|---|---|
| 7,520,015 | B1 * | 4/2009 | Ajello | 15/1.7 |
| 2001/0032809 | A1 * | 10/2001 | Henkin et al. | 210/143 |
| 2004/0079690 | A1 * | 4/2004 | Erlich | 210/169 |
| 2005/0247613 | A1 * | 11/2005 | Bishop et al. | 210/169 |

FOREIGN PATENT DOCUMENTS

| | | |
|---|---|---|
| EP | 1022411 | 7/2000 |
| EP | 1074678 | 2/2001 |
| FR | 2567552 | 1/1986 |
| WO | WO0250288 | 6/2002 |

* cited by examiner

APPARATUS FOR CLEANING SUBMERGED SURFACE WITH EDDY FILTRATION

CROSS REFERENCE TO RELATED APPLICATIONS

This application is the U.S. national phase of International Application No. PCT/FR2008/052366 filed on Dec. 18, 2008 and published on Jul. 2, 2009 as International Publication No. WO 2009/081056 A2, which application claims priority to French Patent Application No. 0708994 filed on Dec. 21, 2007, the entire contents of both of which are incorporated herein by reference.

The invention relates to a device for cleaning a surface which is immersed in a liquid, in particular a swimming pool surface.

A number of known swimming pool cleaning devices comprise:

- a hollow body and members for guiding and driving the body over the immersed surface in a preferred direction of advance and in a main direction of advance, called the longitudinal direction,
- a filtration chamber which is provided in the hollow body and which has:
- at least one liquid inlet located at the base and at the front of the hollow body,
- at least one liquid outlet out of the hollow body, located remotely from the base of the hollow body,
- a hydraulic circuit which is capable of providing a flow of liquid between each inlet and each outlet through a filtering device which is accommodated in the filtration chamber, under the action of a pumping device.

In these known devices (cf., for example, FR 2 567 552, WO 0 250 388, . . . ), the hydraulic circuit extends in the filtration chamber vertically in an upward direction and at the front and the rear of a pumping motor which is arranged vertically, generally at the center of the hollow body. In such devices, the flow of liquid between the inlet and the outlet follows a substantially rectilinear path between the base of the hollow body towards the outlet of the hollow body. It is considered that this arrangement promotes the efficiency of the pump by minimizing the pressure losses and by optimizing the flow and the filtration.

The inventors have now found that this arrangement is extremely unfavorable with respect to the performance levels of the device. It involves a relatively large vertical spatial requirement which results in particular in a higher level of hydraulic resistance to forward movement, and therefore higher energy consumption, a greater weight and size and therefore finally, with equivalent performance levels, a high cost.

Furthermore, the inventors have found that such devices do not have levels of filtration performance which are stable over time, in particular during the cleaning of an immersed surface which is heavily clogged with debris. In particular, the service periods of the device between which a cleaning operation must be carried out are relatively short if the surface is very clogged with debris and in particular very variable depending on the type of waste recovered with the result that they vary randomly for the user. For example, if the pool is clean but the device draws in a single large leaf, this leaf is capable of substantially blocking the filtering device, making it necessary to clean the filtering device. In this manner, the filtration and suction performance levels of these known devices may decrease rapidly in a random manner from the viewpoint of the user and when the quantity of debris recovered is very much lower than the quantity corresponding to the capacity of the filtering device.

Furthermore, a flap for access to the filtration device must be provided in order to allow it to be disassembled in order for it to be cleaned. In the prior devices, the flap for access to the filtration device must be located at the base of the hollow body, the liquid inlets being necessarily provided with non-return devices, such as valves. This arrangement is not convenient for the user who must invert the device beforehand, which can damage it and further bring about undesirable occurrences of untimely flow.

In this context, an object of the invention is therefore to provide, for cleaning an immersed surface, a device whose performance/cost ratio is greatly improved relative to that of prior devices.

More specifically, an object of the invention is to provide such a device whose cost can be substantially reduced, with performance levels which are equivalent to or even greater than those of known devices.

An object of the invention is also to provide such a device whose levels of filtration performance are stable over time, regardless of the nature of the debris, including when cleaning an immersed surface which is heavily clogged with debris, in particular large debris of a size which is equivalent to a 2 Euro coin or leaves.

An object of the invention is also to provide such a device which may have an access flap located at the top, but with a filtration device which has a large storage volume for debris and a simple hydraulic circuit.

To this end, the invention relates to a device for cleaning an immersed surface comprising:

- a hollow body and members for guiding and driving the body over the immersed surface in a preferred direction of advance and in a main direction of advance, called the longitudinal direction,
- in the hollow body, a filtration chamber comprising:
- at least one liquid inlet into the hollow body, located at the base and at the front of the hollow body,
- at least one liquid outlet out of the hollow body, located remotely from the base of the hollow body,
- a hydraulic circuit which is capable of providing a flow of liquid between each inlet and each outlet, through a filtering device which comprises filtering walls and which is accommodated in the filtration chamber, under the action of a pumping device, characterized in that it comprises:

- at least one liquid outlet out of the hollow body, called the rear outlet, offset towards the rear in the longitudinal direction from each liquid inlet with which it is in communication via the hydraulic circuit,
- a rigid wall, called the turbulent wall, which is provided in the filtering device, upstream of the filtering walls, and which extends in a direction which is non-parallel with at least one direction which connects a liquid inlet and a rear outlet, in order to form an obstacle to the flow of liquid from this liquid inlet towards this liquid outlet which brings about a swirling flow of liquid in the filtering device downstream of this rigid wall.

The inventors have found that the provision of a rigid wall in the path of the liquid between a liquid inlet and a rear liquid outlet which at first may seem unfavorable, both in terms of the pressure loss and in terms of the quality of the suction, in reality, when this wall is arranged upstream of the filtering walls, allows the filtering performance levels to be improved by the generation of a swirling flow within the filtering device which permanently retains the debris in suspension in the filtering device, thereby preventing the filtering walls of the filtering device from becoming clogged, and finally promoting the hydrodynamic performance levels of the filtering device and the hydraulic circuit.

That is to say, the pressure losses brought about by the arrangement of a rigid wall on the liquid flow path are compensated for by retaining the initial permeability of the filtering walls of the filtering device. Furthermore, the service periods between which the device must be cleaned are longer and in particular are of a substantially constant length of time, which leads to greater user comfort.

Furthermore, this turbulent wall also acts as a non-return wall in such a manner that the debris which have passed this wall can no longer be discharged via the liquid inlet, including when the pumping device is idle, which eliminates the need to provide valves or other non-return devices at the liquid inlets.

Furthermore, this arrangement allows the device to be configured so as to recover directly at least part of the residual hydraulic energy in the outlet flow in order to contribute to driving the device.

Consequently, at equivalent suction and cleaning performance levels, a device according to the invention may be provided with a pumping motor—in particular an electric pumping motor—and a driving device—in particular comprising at least one electric drive motor—whose power is reduced, and which therefore has lower consumption and costs. The volume and weight of the device are also generally lower which, in addition to the savings made, is a significant advantage for the user, in particular in terms of handling, transport and storage of the device.

The turbulent wall may be arranged at any point of the filtering device, upstream of the filtering walls, that is to say, in the unclean portion of the hydraulic circuit. In particular, it may extend from an upper or lower portion of the filtering device. However, this wall preferably extends in the vicinity of a liquid inlet, downstream of this liquid inlet.

Advantageously and according to the invention, the filtering device comprises a front opening which is provided opposite an upper end of a liquid inlet conduit which extends from at least one liquid inlet, this front opening being in communication with each liquid inlet and, for filtering and recovering the debris, a pocket which is delimited by filtering walls and which extends towards each rear outlet, the inlet conduit having a transverse rear wall which forms the turbulent wall.

The turbulent wall formed by the rear transverse wall of the inlet conduit acts as a non-return wall and prevents the debris from leaving the pocket for filtering and recovering debris in order to return towards the immersed surface via the front opening.

According to a variant, this wall may extend in a generally vertical plane between a zone at the rear of the liquid inlets and the upper front opening of the pocket for filtering and recovering debris. Preferably, this non-return wall extends over a main portion of the height of the inlet conduit, in particular over more than 75% of the height of the inlet conduit.

Advantageously and according to the invention, the inlet conduit extends in a direction, called the liquid inlet direction, forming with at least one middle direction which extends through the front opening and a rear outlet which is in communication with this front opening, an acute angle in order to promote the occurrences of turbulence of the liquid in the pocket for filtering and recovering debris.

Such an arrangement of the inlet conduit relative to each rear outlet increases the occurrences of turbulence generated by the turbulent wall.

Advantageously and according to the invention, the pocket for filtering and recovering debris extends immediately downstream of and below the front opening.

Advantageously and according to the invention, each rear outlet is located below the front opening of the filtering device.

According to this variant, the turbulent wall has an upper end which defines the lower end of the opening of the filtering device and which defines a high point relative to each rear outlet. That is to say, the distance between the upper end of the turbulent wall and the immersed surface is greater than each distance between each rear outlet and the immersed surface.

Advantageously and according to the invention, the turbulent wall extends over more than 75% of the maximum height of the pocket for filtering and recovering debris.

Such a turbulent wall allows the generation, in the filtration pocket, of a swirling flow whose vortex of fluid extends in the entire filtration pocket so that the majority of the debris present in the filtration pocket is in permanent suspension in the pocket for as long as the pumping device is operational, which prevents the filtering walls from becoming blocked by these debris, and finally promotes the hydrodynamic performance levels of the filtering device and the hydraulic circuit.

The pocket for filtering and recovering debris may be of any type.

Advantageously and according to the invention, the pocket for filtering and recovering debris comprises a rigid frame and a filtering sheet which extends into openings which are provided by the rigid frame.

Such a filtering device is self-supporting and can be readily operated by a user in order, for example, to withdraw the filtering device in order to remove the debris collected by the debris recovery pocket.

Advantageously and according to the invention, the hydraulic circuit comprises at least one axial pumping propeller which is arranged downstream of the filtering device in order to generate a flow of liquid in a liquid outlet, the axial pumping propeller being coupled to a driving motor which is arranged below a rear portion of the filtration device.

The pumping motor is preferably arranged below the inclined lower wall of the pocket for filtering and recovering debris.

Such an arrangement is more compact and allows the vertical and horizontal size of the device to be significantly reduced which contributes to reducing the hydraulic drag of the device.

Advantageously and according to the invention, the axial pumping propeller is arranged in a cylindrical fairing which forms the liquid outlet.

Advantageously and according to the invention, the axial pumping propeller and the cylindrical fairing are orientated so as to generate a liquid flow in a direction which forms, with the longitudinal direction, an angle which is not equal to zero and which is different from 90°.

Advantageously, a device according to the invention further comprises, for access to the filtering device, a flap which is provided on an outer wall of the hollow body and which is capable of allowing the filtering device to be disassembled and removed from the hollow body in order to be cleaned.

This access flap may be provided on any wall of the hollow body of the device, in particular on a front wall or on an upper wall.

However, advantageously and according to the invention, the access flap is provided on the upper wall of the hollow body.

This allows the filtering device to be removed readily and rapidly from the upper wall of the hollow body. It is therefore simple with a device according to the invention, to remove the filtering device, in order, for example, to clean it, the device being in its normal position on a surface, that is to say, the base of the device facing the ground. This disassembly does not involve inverting the device.

Advantageously and according to the invention, the filtering device comprises ribs which extend laterally at each side of the filtering device and which have a shape and dimensions which correspond to and complement the shape and dimensions of grooves which are fixedly joined to the hollow body in order to be able to slide the filtering device along the grooves in order to remove the filtering device from the hollow body via the access flap.

In this manner, removing the filtering device from the hollow body via the upper flap is the result of a translation movement of the filtering device along the grooves of the hollow body. A user can therefore readily remove the filtering device from the hollow body in order, for example, to clean it. After the filtering device has been cleaned, a user can readily reintroduce the filtering device into the hollow body by orientating the filtering device so that the ribs of the filtering device are opposite the grooves of the hollow body, then sliding the filtering device into the hollow body.

The invention further relates to a device for cleaning an immersed surface characterized in combination by all or some of the features mentioned above or below.

Figure 2:
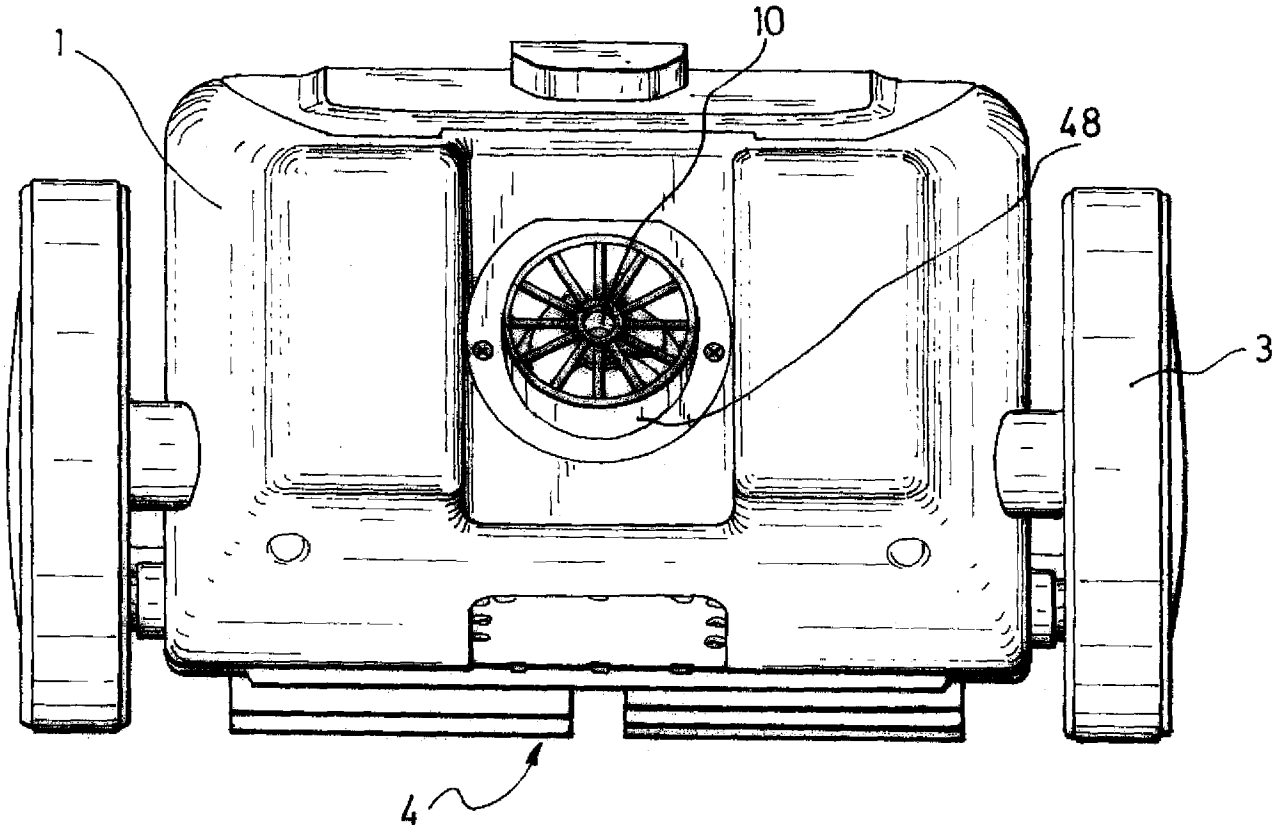
Figure 3:
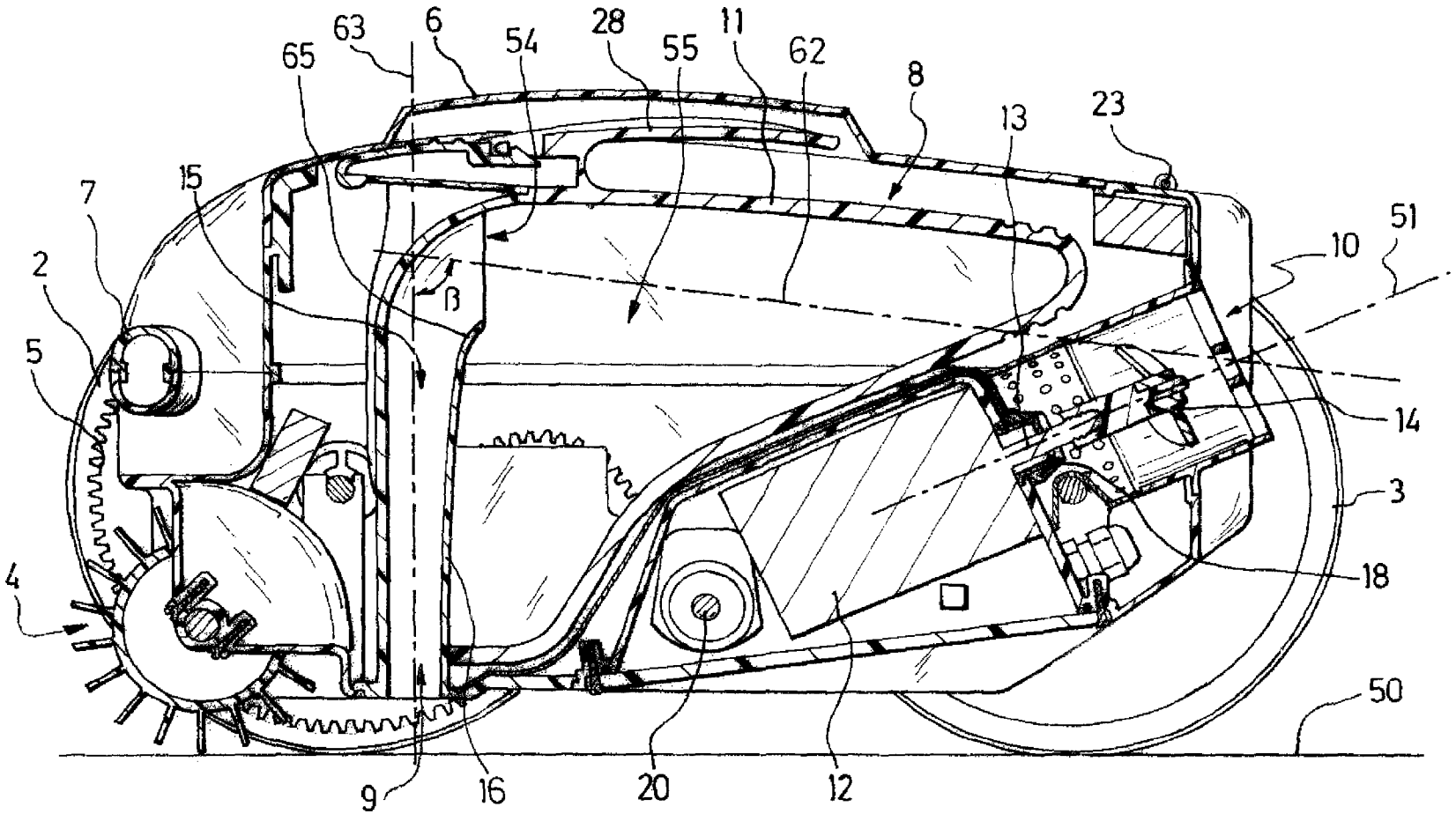
Figure 4:
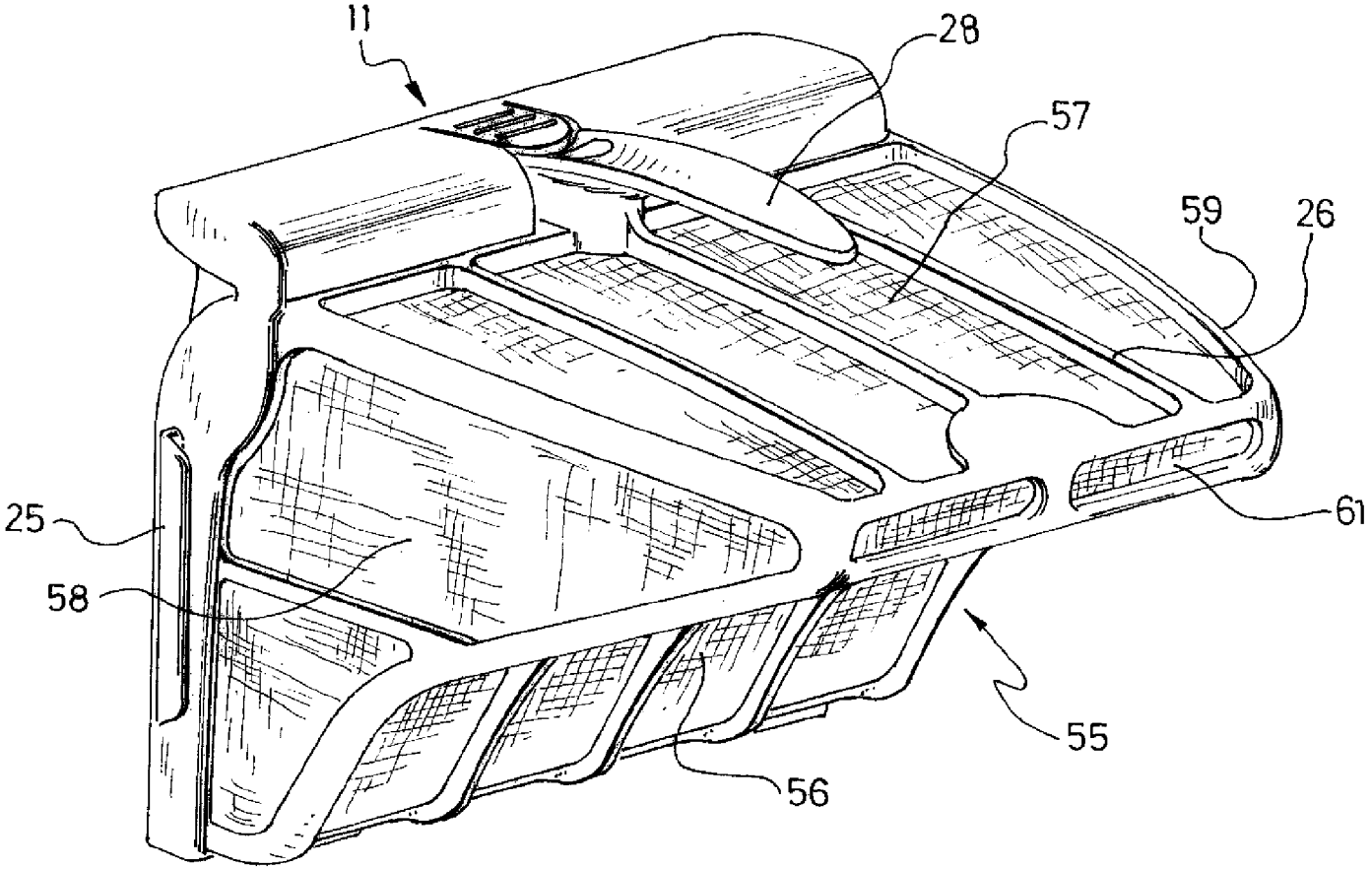
Figure 5:
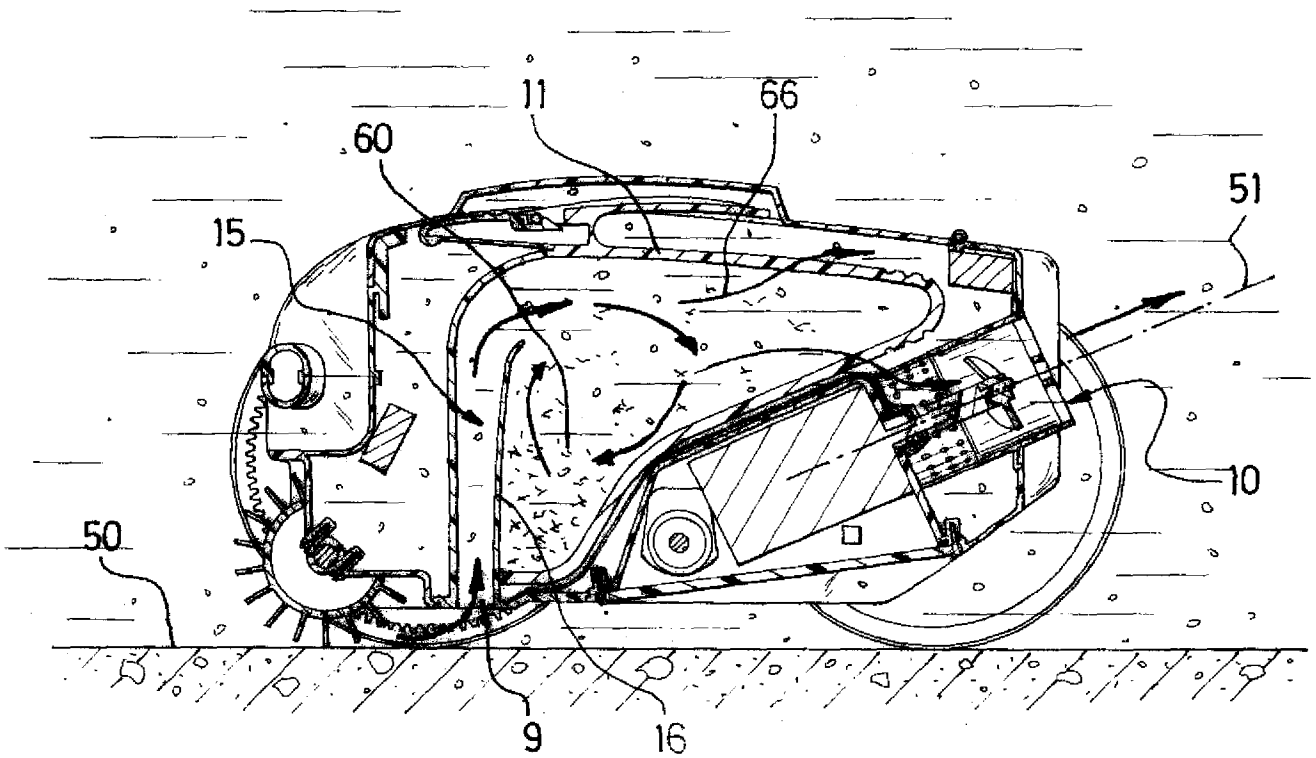
Figure 6:
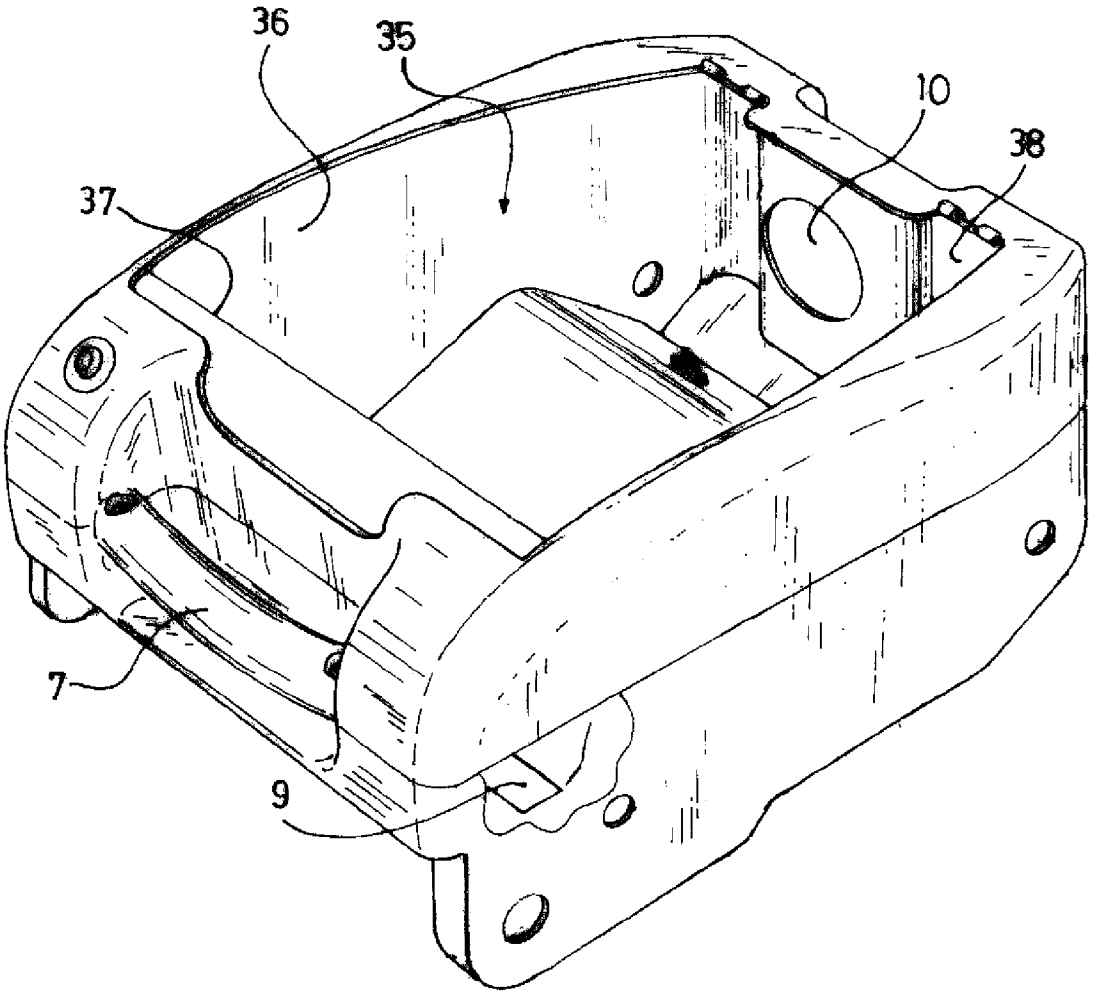

Other features, objectives and advantages of the invention will be appreciated from a reading of the following description which sets out, by way of non-limiting example, an embodiment of the invention with reference to the appended drawings, in which:

FIG. 1 is a schematic perspective view of a cleaning device according to an embodiment of the invention, FIG. 2 is a schematic rear view of a cleaning device according to an embodiment of the invention, FIG. 3 is a schematic section of a cleaning device according to an embodiment of the invention, FIG. 4 is a schematic perspective view of a filtering device according to an embodiment of the invention, FIG. 5 is a simplified schematic section of FIG. 3 illustrating the device during operation on an immersed surface, FIG. 6 is a schematic perspective view of a housing of a device according to an embodiment of the invention.

In the Figures, the scales and proportions are not strictly complied with for the purposes of illustration and clarity.

In all of the following detailed description with reference to the Figures, unless indicated otherwise, each component of the cleaning device is described as it is arranged when the device is moving normally over a horizontal immersed surface in a preferred direction of advance, relative to which the front and the rear of the device are defined.

A device according to the invention comprises a hollow body 1 and travel members 2, 3, 4 for guiding and driving the hollow body 1 over an immersed surface in at least one preferred direction of advance and in a main direction of advance called the longitudinal direction, parallel with the immersed surface.

This hollow body 1 is formed principally by a concave housing which delimits a main chamber. This concave housing is, for example, produced by means of molding or rotational molding. This housing is preferably produced from a thermoplastic material, such as polyethylene, polypropylene, ABS, PMMA or any equivalent material.

This hollow body 1 has, as illustrated in FIG. 6, a central chamber 35 which is capable of receiving a filtration chamber. This central chamber 35 is delimited by a lower wall which extends in a substantially horizontal plane; by lateral walls 36 which generally extend in vertical planes; by a front wall 37 which generally extends in a vertical plane, orthogonal relative to the planes of the vertical lateral walls 36; and by a rear wall 38 which generally extends in a vertical plane orthogonal relative to the planes of the vertical lateral walls 36.

The lower wall has an opening which extends transversely in the region of the front wall 37 so that liquid is able to be introduced into the central chamber 35 via this lower transverse opening. This opening forms a liquid inlet 9 in the hollow body 1.

The rear wall 38 comprises a cylindrical opening which forms a liquid outlet 10 out of the hollow body 1. This liquid outlet 10 which is provided in the rear wall 38 of the housing is longitudinally offset from the liquid inlet 9 which is provided in the lower wall. Furthermore, this liquid outlet 10 is provided in the upper portion of the housing in such a manner that it is also vertically offset from the liquid inlet 9.

As illustrated in particular in FIG. 3, this central chamber 35, this liquid inlet 9 and this liquid outlet 10 form a filtration chamber 8. This filtration chamber 8 further comprises a hydraulic circuit which is capable of providing a flow of liquid between the liquid inlet 9 and the liquid outlet 10 through a filtering device 11.

The central chamber of the hollow body 1 is capable of receiving a filtering device 11. The filtering device 11 is provided between the liquid inlet 9 and the liquid outlet 10.

According to the invention, this filtering device 11 comprises a front opening 54 which is in communication with the liquid inlet 9 and a pocket 55 for filtering and recovering debris. This pocket 55 extends between the front opening 54 and the liquid outlet 10.

The filtering device 11 further comprises a liquid inlet conduit 15 which extends from the liquid inlet 9 as far as the front opening 54 which is connected to the pocket 55 for filtering and recovering debris. In this manner, the front opening 54 is provided opposite the upper end of this liquid inlet conduit 15 which extends from the liquid inlet 9. This liquid inlet conduit 15 has a rear wall which is called the turbulent wall 16 and which is arranged between the liquid inlet and the pocket 55 for filtering and recovering debris.

The pocket 55 for filtering and recovering debris is formed by a rigid frame 26 and a filtering sheet which extends into openings which are provided in this rigid frame. It thus comprises, as illustrated in FIG. 4, filtering walls 56, 57, 58, 59. The filtering device 11 is therefore self-supporting and can be readily handled by a user.

The turbulent wall 16 generates occurrences of turbulence in the pocket 55 for filtering and recovering debris upstream of the filtering walls 56, 57, 58, 59. As illustrated in particular in FIG. 3, this wall 16 has a curved upper extreme portion 65.

The turbulent wall 16 extends transversely between the lateral walls 58, 59 of the pocket 55 for filtering and recovering debris. The turbulent wall 16 extends over a main portion of the height of the pocket 55 for filtering and recovering debris.

The turbulent wall 16 generally extends in a plane which is substantially perpendicular relative to the immersed surface over which the device moves. This turbulent wall 16 extends from the base of the filtering device 11, in the direction away from the immersed surface as far as the front opening defined between an upper edge of this turbulent wall 16 and the upper wall 57 of the filtration pocket 55 which generally extends in a plane parallel with the immersed surface.

According to an advantageous embodiment, the inlet conduit 15 extends in a direction, called the liquid inlet direction 63, and forms with the central direction 62 which connects the front opening to the liquid outlet 10, an acute angle β in order to promote the occurrences of turbulence of the liquid in the pocket 55 for filtering and recovering debris.

According to the embodiment of the Figures and as illustrated in FIG. 3, the angle β is in the order of 80° which allows significant levels of turbulence to be created whilst maintaining a high liquid flow.

These occurrences of turbulence retain the debris in suspension in the pocket 55 for filtering and retaining debris, which prevents the filtering walls 56, 57, 58 and 59 of the filtering device 11 from becoming clogged by these debris.

Furthermore, the pocket 55 for filtering and recovering debris has a regular cross-section which decreases from the front opening 54 towards the liquid outlet 10 in order to form a tangential convergent filtering chamber for the liquid flowing between the front opening 54 and the liquid outlet 10. This tangential filtration is also involved in preventing the filtering walls 56, 57, 58 and 59 of the filtering device 11 from becoming clogged by the debris which are drawn in by the device.

The pocket 55 for filtering and recovering debris has a lower filtering wall 56 which is inclined in an upward direction towards the rear from a lower portion of the pocket 55.

This filtration pocket 55 further comprises a substantially horizontal upper wall 57 which extends from the front opening 54 to the rear. This upper filtering wall 57 is connected to the lower filtering wall 56 via an upper rear extreme curved portion 61.

The device also comprises, as illustrated in FIG. 1, a flap 6 for access to this filtering device 11. This access flap 6 forms an upper wall of the hollow body 1 and covers it. In the embodiment illustrated, this flap 6 is provided on the upper portion of the device in such a manner that a person using the device can readily open the flap 6 and remove the filtering device 11. Preferably, the access flap 6 is articulated to the body 1 of the device by means of hinges 23 which are provided at the rear of the device.

Preferably, the filtering device 11 is a device which is mounted in the central chamber 35 of the hollow body 1 in the manner of a drawer. To this end, the rigid frame 26 of the filtering device 11 has two ribs 25 which extend laterally from each side of the filtering device 11. These ribs 25 have shapes and dimensions which correspond to and complement the shapes and dimensions of grooves which are fixedly joined to the hollow body 1. These grooves which are fixedly joined to the hollow body 1 extend vertically along the inner faces of the vertical lateral walls of the hollow body 1. The ribs 25 of the filtering device 11 are therefore capable of co-operating with the grooves of the hollow body 1 of the device.

In this manner, the removal of the filtering device 11 is the result of a translation movement of the filtering device 11 along the grooves of the hollow body 1. A user can therefore readily remove the filtering device 11 from the hollow body 1, for example, in order to clean it. After the filtering device 11 has been cleaned, a user can readily reintroduce the filtering device 11 into the hollow body 1 by orientating the filtering device 11 so that the ribs 25 of the filtering device 11 are opposite the grooves of the hollow body, then by sliding the filtering device 11 in the hollow body 1.

The filtering device 11 further comprises a handle 28 which is provided on an upper portion of the filtering device 11 in order to facilitate handling of the filtering device 11. In particular, a user is able to readily assemble/disassemble the filtering device 11 using this handle 28 when the device is taken out of the liquid and is resting on a horizontal surface.

According to the invention, a device comprises a motorized liquid pumping device which comprises an electric pumping motor 12 which has a rotating drive shaft 13 which is coupled to a pumping propeller 14 which is interposed in the hydraulic circuit in order to generate a liquid flow therein between the liquid inlet 9 and the liquid outlet 10. The liquid outlet 10 is directly opposite the pumping propeller so that the liquid flows out of the hollow body 1 via the liquid outlet 10 in a direction which corresponds to the liquid flow generated by the pumping propeller, this flow having a speed which is orientated in accordance with the rotation axis 51 of the propeller 14.

The pumping propeller 14 has an orientation which allows a flow of liquid to be generated with a horizontal component towards the rear.

Preferably, the pumping propeller 14 which is interposed in the hydraulic circuit between the liquid inlet 9 and liquid outlet 10 has an inclined rotation axis which forms, with the longitudinal direction and with the theoretical rolling plane 50, an angle α which is not equal to 90°. This propeller 14 is rotated by means of an electric pumping motor 12 which preferably has a rotating drive shaft 13 which is parallel with the rotation axis of the propeller 14.

According to the invention, the pumping motor is arranged below the hydraulic circuit entirely at the outer side of this hydraulic circuit so that the filtering device 11 of the hydraulic circuit can be removed from the device via the top of the device as mentioned above, without being impeded by the pumping motor. Only the pumping propeller 14 is arranged in the hydraulic circuit so as to be able to bring about the liquid flow. This pumping propeller 14 is arranged at the rear of the device, close to the liquid outlet 10. That is to say, the pumping propeller 14 and the liquid outlet 10 form the end portion of the hydraulic circuit.

The rotating shaft 13 of the electric pumping motor 12 extends through a lower inclined wall 30 which delimits the hydraulic circuit. The sealing is provided by an O-ring 18.

According to a preferred embodiment, the electric pumping motor is a low-voltage motor. It can be supplied with electrical power via an electrical power supply external to the device via an electrical cable which is not illustrated in the Figures and which is connected to the device in the region of a zone 19 for introducing the electrical cable into the device, as illustrated in FIG. 1.

FIG. 5 is an illustration of the flow of liquid in the hollow body 1 of the device. This flow is illustrated schematically in FIG. 5 by means of arrows 66. Liquid enters the hollow body 1 via the liquid inlet 9 which is arranged below the device. This liquid passes into the liquid inlet conduit 15 in order to reach the filtering device 11. Occurrences of turbulence are generated by passing close to the turbulent wall 16 which retains the debris 60 in suspension. This filtering device 11 allows the liquid to pass through the filtering material and retains the solid debris 60. The filtered liquid reaches the liquid outlet 10 and is discharged at the rear of the device into the pool from which it originates. FIG. 5 is also an illustration of the turbulent flow generated by the turbulent wall 16 immediately downstream of the turbulent wall 16.

Since the liquid outlet 10 is opposite the pumping propeller 14, the liquid flows out of the device via this outlet with a speed V which is orientated along the axis 51 of the pumping propeller 14 and which has a longitudinal component towards the rear which brings about, by means of reaction, forces whose resultant has a longitudinal drive component which is orientated towards the front and which is involved in driving the device over the immersed surface.

The orientation of the hydraulic reaction force created by this discharge flow and therefore the size of the longitudinal component thereof are dependent on the inclination, relative to the theoretical rolling plane 50, of the rotation axis 51 of the propeller and the liquid outlet 10. Preferably, this inclination is between 15° and 45°.

In the preferred embodiment of the invention illustrated in the Figures, the rolling members for guiding and driving the device comprise a front axle which comprises two front drive wheels 2, one at each side, and a rear axle which comprises rear non-drive wheels 3, one at each side.

Furthermore, preferably and as illustrated in the Figures, the device comprises brushes 4 which are arranged at the front of the device. These brushes 4 are intended to brush the immersed surface and move the debris which are brushed towards the rear of the device in the direction of the liquid inlet 9 which is arranged below the device.

The device further comprises at least one electric motor 20 for driving the front drive wheels 2. Preferably, the device comprises two drive motors, one at each side, for independently driving each of the front wheels 2, respectively. To this end, each front wheel 2 has an internal toothed arrangement 5 which co-operates with a pinion which is driven by the corresponding drive motor 20.

These brushes 4 may be of any type. According to one embodiment of the invention, the device comprises two coaxial front brushes 4. Each brush 4 is capable of being rotated about an axis which extends in a direction, which is called the transverse direction, and which is perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

Furthermore, the brushes 4 are preferably also rotated by at least one electric motor 20 for driving the front wheels 2 by means of a gear system.

In this manner, in the embodiment illustrated, the rolling members are constituted by the front drive wheels 2, rear non-drive wheels 3 and brushes 4 which are involved in driving and guiding the device over the immersed surface. Nonetheless, the rolling members 2, 3, 4 have zones which are intended to come into contact with the immersed surface which are coplanar and define a theoretical rolling plane 50. The longitudinal direction of advance of the device is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, these front wheels 2 facilitate the passing of obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the device, in particular the hollow body, in order to form the extreme front portion of the device and first come into contact with an obstacle which is encountered during the forward movement.

Furthermore, according to a preferred embodiment of the invention, the device also comprises an operating handle 7 which allows a user to carry the device in order to immerse it in a liquid and remove it therefrom. This handle 7 is preferably arranged opposite the liquid outlet 10 so that, when the hollow body 1 is suspended via this handle, the device tilts spontaneously under the effect of gravity into a position in which the liquid outlet 10 is located below the liquid inlet 9, which allows the device to be emptied. When the device moves from the cleaning position to the emptying position, the debris drawn in by the device are retained in the filtering device and cannot be discharged from the device.

Of course, the invention may involve numerous construction variants and applications.

For example, according to an embodiment which is not illustrated in the Figures, the filtering device 11 may have a plurality of turbulent walls which are arranged in the filtering device 11.

Furthermore, the sizing and the configuration of the device, in particular the hydraulic circuit thereof, are subject to an infinite number of variants. In addition, the invention can be used for a bi-directional device which is capable of backward movement.

The invention claimed is:

1. A swimming pool cleaner comprising:

a. a body comprising an inlet, an outlet, and a base;

b. a pumping device configured to cause water to flow from the inlet to the outlet; and c. a filtering device (i) positioned between the inlet and the outlet so as to filter water flowing therethrough and (ii) comprising an inlet conduit and a filtration pocket, the inlet conduit comprising a first wall extending in a first direction substantially perpendicular to a surface along which the body is configured to move and the filtration pocket having an entrance and defining a central direction for water flowing therein from the entrance of the filtration pocket to the outlet of the body, the first and central directions forming an acute angle such that the central direction is downward, toward the base, when the body is upright.

2. A swimming pool cleaner according to claim 1 in which the filtration pocket comprises lateral walls and the first wall extends transversely between the lateral walls.

3. A swimming pool cleaner according to claim 2 in which the filtration pocket has a height and the first wall extends over a main portion of the height.

4. A swimming pool cleaner according to claim 1 in which the filtration pocket comprises a rigid frame providing openings and a filtering sheet which extends into the openings.

5. A swimming pool cleaner according to claim 1 in which the body includes grooves and the filtering device further comprises ribs engaging the grooves permitting the filtering device to slide along the grooves.

6. A swimming pool cleaner according to claim 1 in which (a) the filtration pocket has a front opening through which water enters and (b) the central direction extends downward from the front opening when the body is upright.

* * * * *